US010312636B2

(12) United States Patent
Yu et al.

(10) Patent No.: US 10,312,636 B2
(45) Date of Patent: Jun. 4, 2019

(54) CONNECTOR WITH REDUCED RESONANCE

(71) Applicant: Tyco Electronics (Shanghai) Co. Ltd., Shanghai (CN)

(72) Inventors: Clarence Yu, Shanghai (CN); Liang Huang, Shanghai (CN); Zhiwei Liu, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 15/788,912

(22) Filed: Oct. 20, 2017

(65) Prior Publication Data

US 2018/0115117 A1 Apr. 26, 2018

(30) Foreign Application Priority Data

Oct. 21, 2016 (CN) ..... 2016 1 0918088

(51) Int. Cl.

| | |
|---|---|
| ***H01R 24/00*** | (2011.01) |
| ***H01R 13/6585*** | (2011.01) |
| ***H01R 12/79*** | (2011.01) |
| ***H01R 24/60*** | (2011.01) |
| ***H01R 13/6471*** | (2011.01) |
| *H01R 107/00* | (2006.01) |
| *H01R 12/71* | (2011.01) |
| *H01R 12/72* | (2011.01) |

(52) U.S. Cl.
CPC ..... *H01R 13/6585* (2013.01); *H01R 12/79* (2013.01); *H01R 13/6471* (2013.01); *H01R 24/60* (2013.01); *H01R 12/716* (2013.01); *H01R 12/724* (2013.01); *H01R 2107/00* (2013.01)

(58) Field of Classification Search
CPC ..... H01R 23/02; H01R 24/62; H01R 24/60
USPC ..... 439/660, 108, 79
See application file for complete search history.

(56) References Cited

U.S. PATENT DOCUMENTS 6,935,870 B2 * 8/2005 Kato ..... H01R 13/6585 439/108

* cited by examiner

*Primary Examiner* — Phuong K Dinh
(74) *Attorney, Agent, or Firm* — Barley Snyder

(57) ABSTRACT

A connector comprises an insulation body and at least two rows of contacts disposed in the insulation body. The at least two rows of contacts extend in a first direction. A plurality of first contacts of a first row of the at least two rows of contacts corresponds to a plurality of second contacts of a second row of the at least two rows of contacts. A pair of corresponding contacts in the first row and second row is staggered in the first direction by a predetermined distance set to be 1.20-1.80 times a contact pitch between a pair of adjacent contacts in each of the first row and second row.

18 Claims, 16 Drawing Sheets

CONNECTOR WITH REDUCED RESONANCE

CROSS-REFERENCE TO RELATED APPLICATION

This application claims the benefit of the filing date under 35 U.S.C. § 119(a)-(d) of Chinese Patent Application No. 201610918088.4, filed on Oct. 21, 2016.

FIELD OF THE INVENTION

The present invention relates to a connector and, more particularly, to a connector having two or more rows of contacts.

BACKGROUND

In known connectors having two or more rows of contacts, referred to as multi-row connectors, resonance between two adjacent rows of contacts restricts electrical performance of the connector. In order to reduce the volume of the multi-row connector, two adjacent rows of contacts are generally designed to be relatively close, which results in relatively strong electrical coupling between the two adjacent rows of contacts, resulting in relatively strong resonance between the two adjacent rows of contacts. If the inter-row resonance between the two adjacent rows of contacts is strong, frequency domain crosstalk between the two adjacent rows of contacts peaks, causing time-domain concussion and other issues. There is a need to reduce or eliminate the resonance between adjacent rows of contacts without excessively increasing the volume of the multi-row connector.

SUMMARY

A connector according to the invention comprises an insulation body and at least two rows of contacts disposed in the insulation body. The at least two rows of contacts extend in a first direction. A plurality of first contacts of a first row of the at least two rows of contacts corresponds to a plurality of second contacts of a second row of the at least two rows of contacts. A pair of corresponding contacts in the first row and second row is staggered in the first direction by a predetermined distance set to be 1.20-1.80 times a contact pitch between a pair of adjacent contacts in each of the first row and second row.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
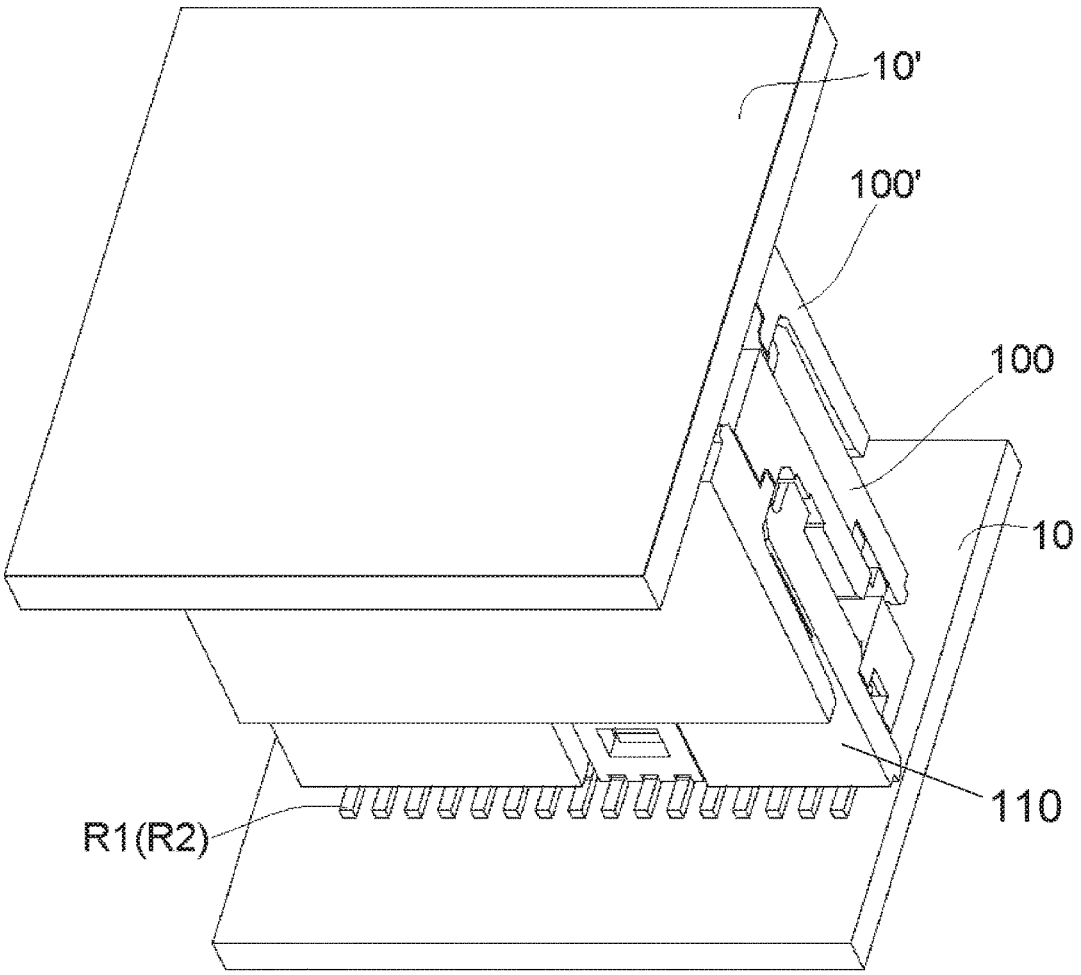
FIG. 1 is a perspective view of a connector according to an embodiment of the invention mated with a mating connector.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

A connector 100 according to an embodiment of the invention is shown in FIGS. 1-13. The connector 100, as shown in FIGS. 1 and 2, comprises an insulation body 110 and at least two rows of contacts R1, R2 disposed in the insulation body 110.

Figure 3:
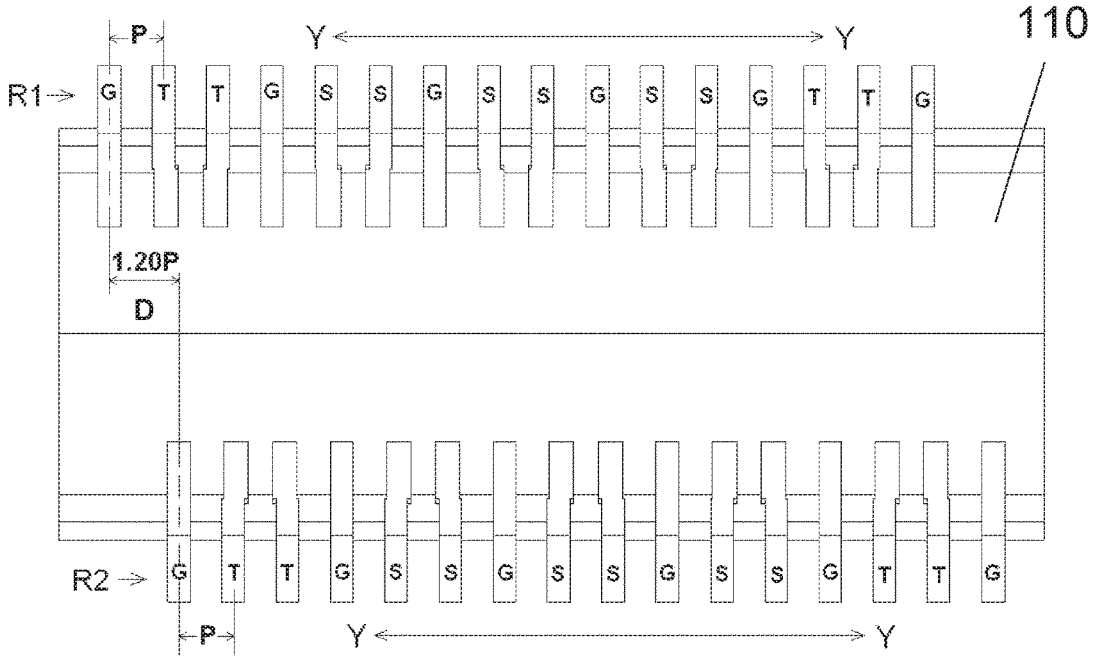
FIG. 3 is a plan view of two adjacent rows of contacts of the connector of FIG. 1 staggered by a first predetermined distance.

The two rows of contacts R1, R2, as shown in FIG. 3, have contacts corresponding with one another within the insulation body 110. Each row of contacts R1, R2 is arranged in a first direction Y and comprises at least one pair of high-speed differential signal contacts S, S; in the shown embodiment, each row of contacts R1, R2 comprises three pairs of high-speed differential signal contacts S, S. Each side of each pair of high-speed differential signal contacts S, S in each row of contacts R1, R2 is provided with a ground contact G. Each row of contacts R1, R2 is also provided with at least one pair of low-speed differential signal contacts T, T; in the shown embodiment, each row of contacts R1, R2 is provided with two pairs of low-speed differential signal contacts T, T. Each side of each pair of low-speed differential signal contacts T, T is also provided with a ground contact G. Thus, any two adjacent pairs of differential signal contacts S, S or T, T in each row of contacts R1, R2 are separated by a ground contact G.

Figure 2:
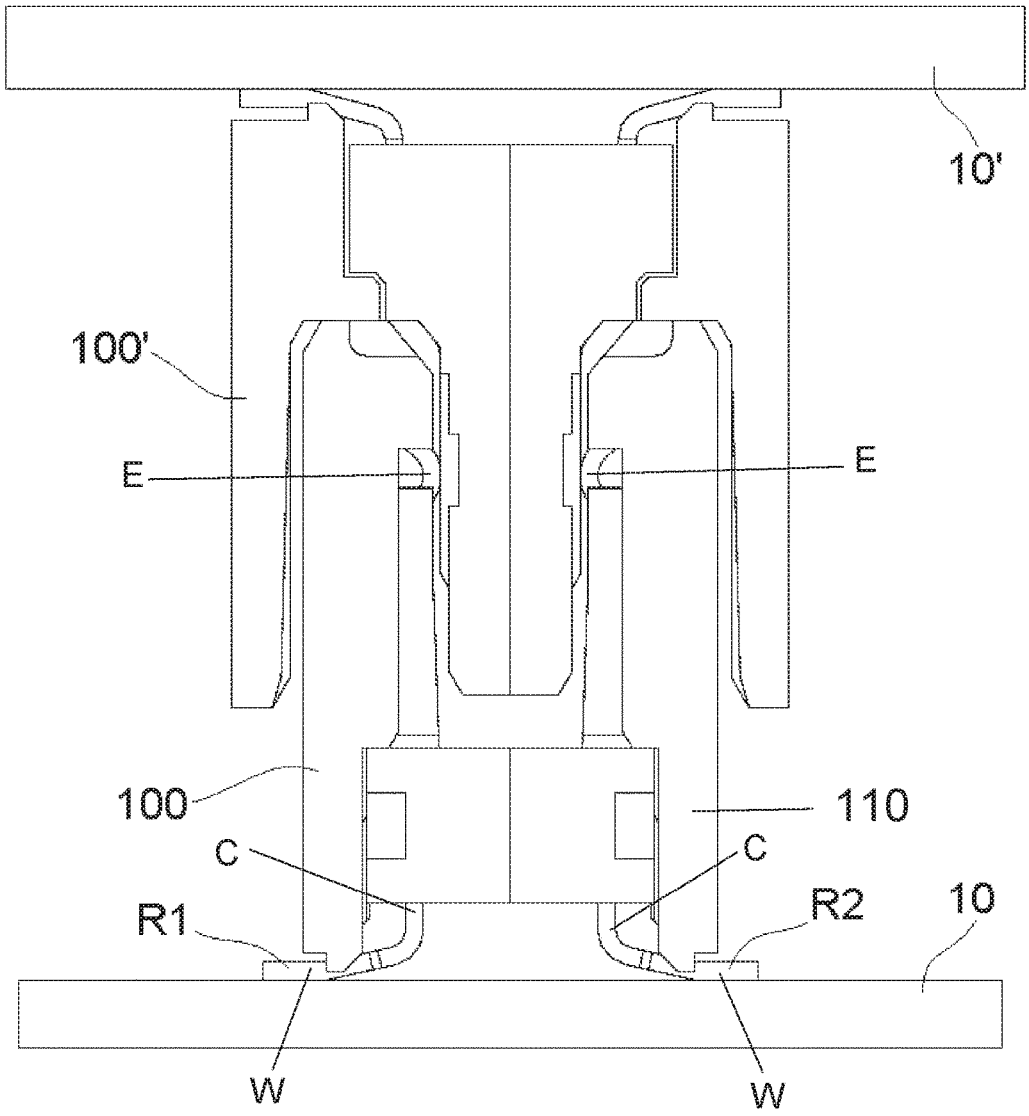
FIG. 2 is a sectional view of the connector and the mating connector of FIG. 1.

As shown in FIGS. 1 and 2, each contact of each row of contacts R1, R2 comprises a soldering portion W adapted to be soldered to a circuit board 10, a contact portion E adapted to be in electrical contact with a mating connector 100', and a connecting portion C connecting the soldering portion W and the contact portion E. In the embodiment shown in FIGS. 1 and 2, the connecting portion C is substantially perpendicular to a surface of the circuit board 10. The mating connector 100' is soldered onto another circuit board 10'. The circuit board 10 and the circuit board 10' are electrically connected to each other through the connector 100 and the mating connector 100'.

Figure 4:
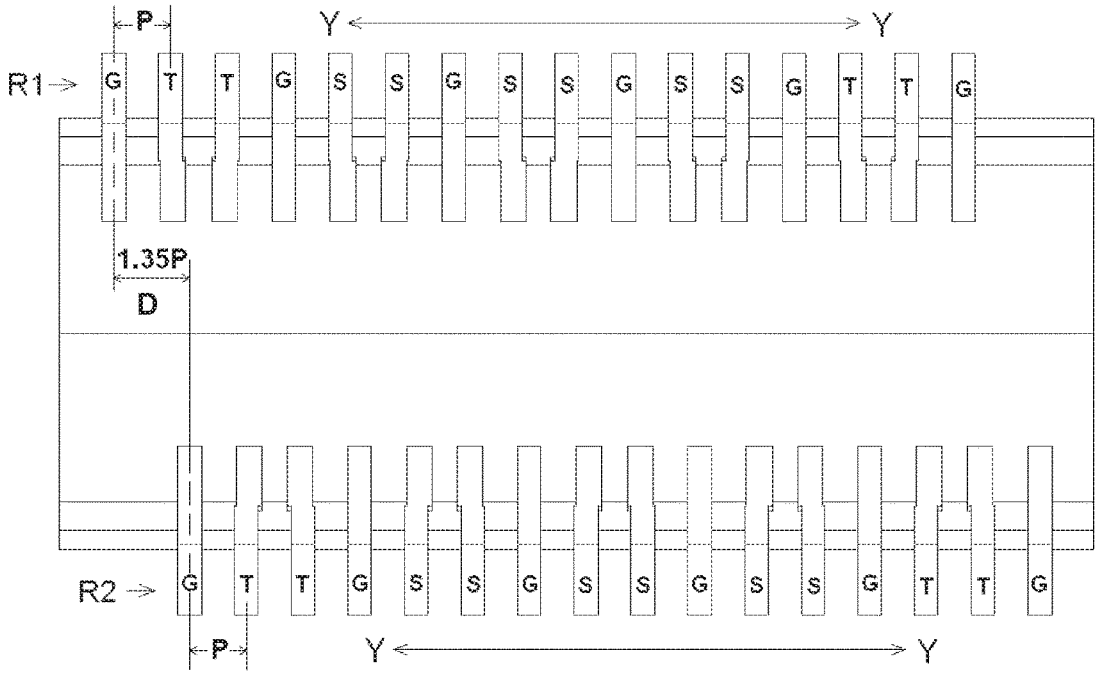
FIG. 4 is a plan view of two adjacent rows of contacts of the connector of FIG. 1 staggered by a second predetermined distance.
Figure 5:
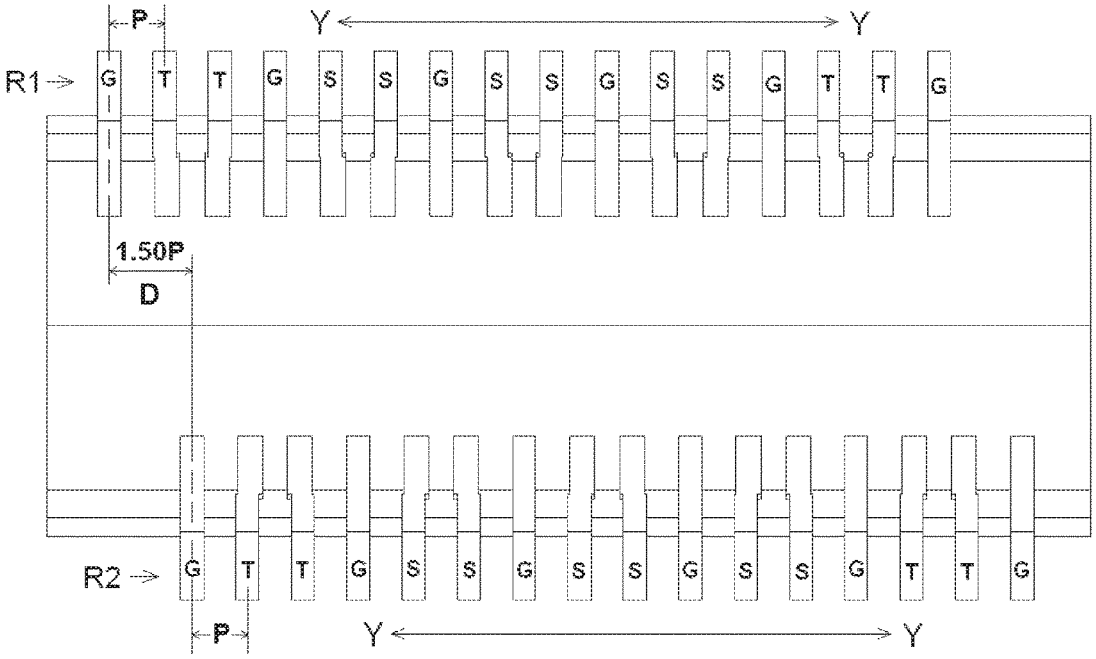
FIG. 5 is a plan view of two adjacent rows of contacts of the connector of FIG. 1 staggered by a third predetermined distance.
Figure 6:
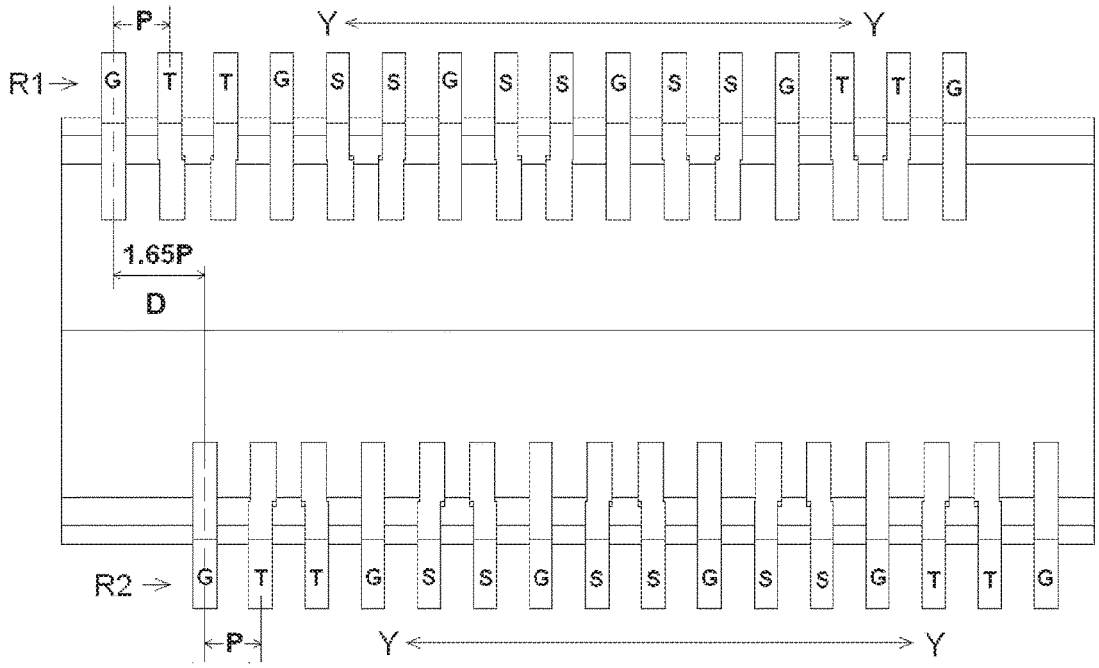
FIG. 6 is a plan view of two adjacent rows of contacts of the connector of FIG. 1 staggered by a fourth predetermined distance.
Figure 7:
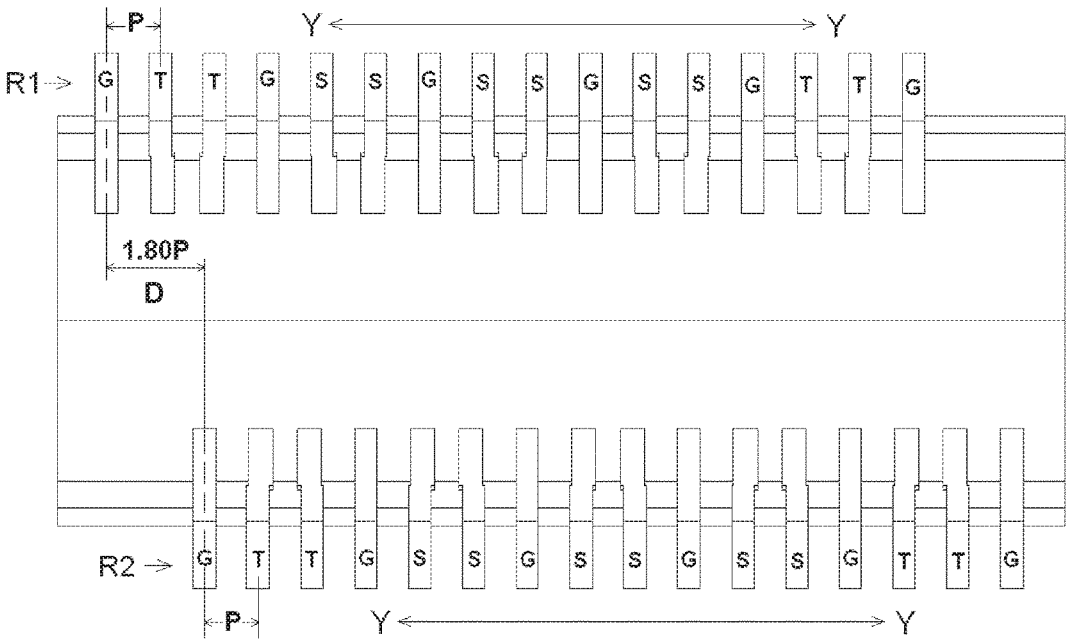
FIG. 7 is a plan view of two adjacent rows of contacts of the connector of FIG. 1 staggered by a fifth predetermined distance.

Any two corresponding contacts, which are arranged in the two adjacent rows of contacts R1, R2, respectively, are at least partially staggered in the first direction Y by a predetermined distance D as shown in FIG. 7, so as to suppress the resonance between the two adjacent rows of contacts R1, R2. As shown in FIGS. 3-7, the predetermined distance D may be set to be 1.20-1.80 times of a contact pitch P between two adjacent contacts in each row of contacts R1, R2. In another embodiment, the predetermined distance D may be set to be 1.35-1.65 times the contact pitch P. As shown in FIG. 3, any two corresponding contacts of the two adjacent rows of contacts R1, R2 are staggered in the first direction Y by a distance 1.2 P; as shown in FIG. 4, any two corresponding contacts of the two adjacent rows of contacts R1, R2 are staggered in the first direction Y by a distance of 1.35 P; as shown in FIG. 5, any two corresponding contacts of the two adjacent rows of contacts R1, R2 are staggered in the first direction Y by a distance of 1.5 P; as shown in FIG. 6, any two corresponding contacts of the two adjacent rows of contacts R1, R2 are staggered in the first direction Y by a distance of 1.65 P; and shown in FIG. 7, any two corresponding contacts of the two adjacent rows of contacts R1, R2 are staggered in the first direction Y by a distance of 1.8 P.

FIGS. 8-13 show graphs of a frequency domain crosstalk between the two adjacent rows of contacts R1, R2 of the connector 100 in the case where the two corresponding contacts of the two adjacent rows of contacts R, R2 are not staggered, staggered by a distance of 1.2 P, staggered by a distance of 1.35 P, staggered by a distance of 1.5 P, staggered by a distance of 1.65 P and staggered by a distance of 1.8 P, respectively.

Figure 8:
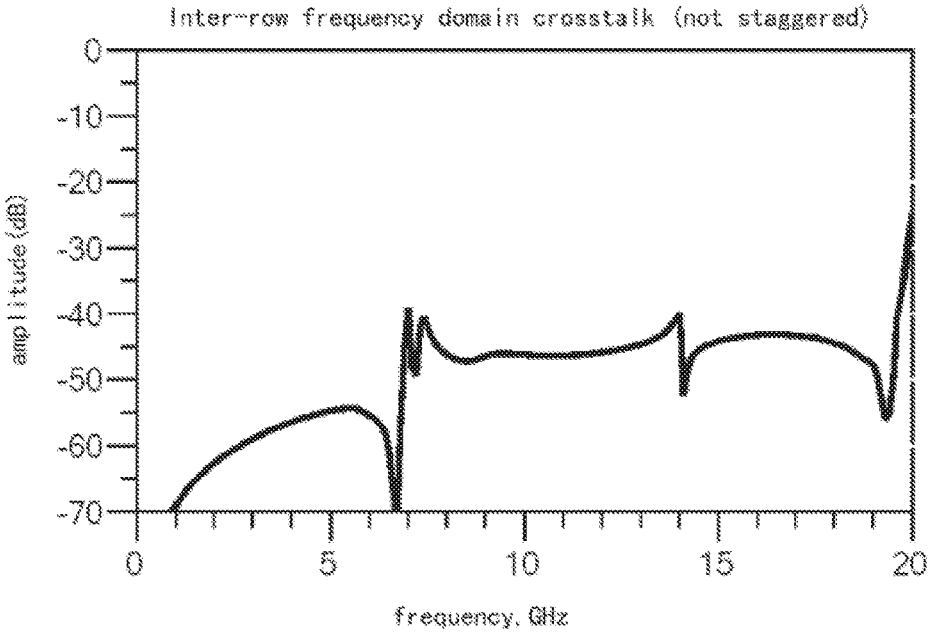
FIG. 8 is a graph of a frequency domain crosstalk between the two adjacent rows of contacts of the connector of FIG. 1 in the case where two corresponding contacts of the two adjacent rows of contacts are not staggered.
Figure 9:
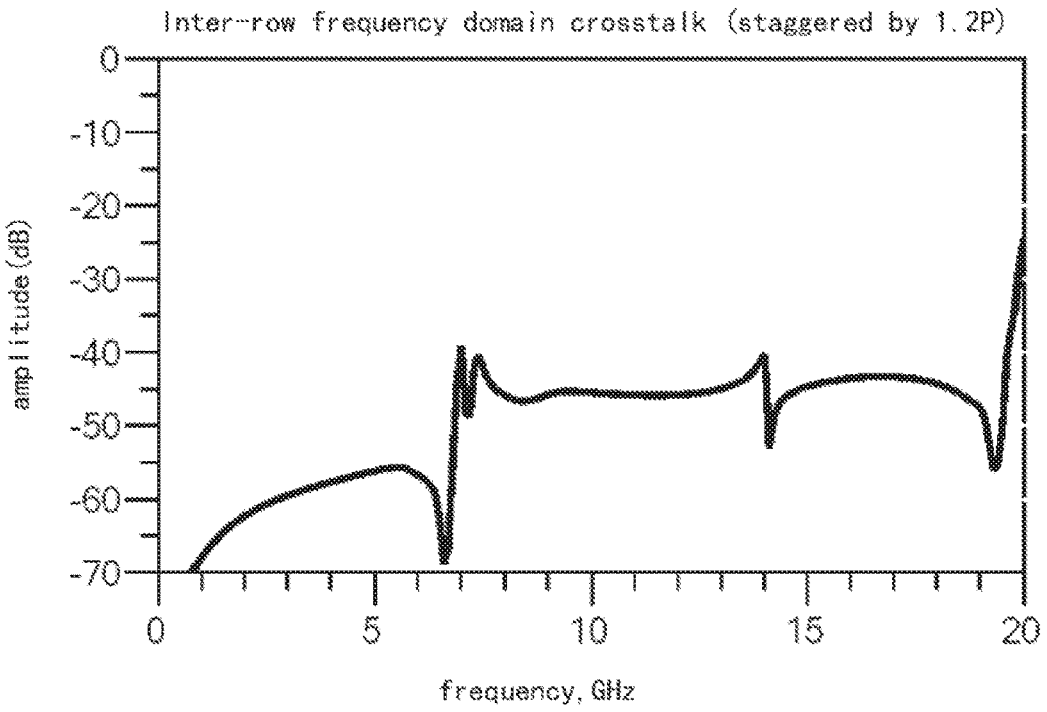
FIG. 9 is a graph of a frequency domain crosstalk between the two adjacent rows of contacts of the connector of FIG. 1 in the case where two corresponding contacts of the two adjacent rows of contacts are staggered by the first distance.
Figure 10:
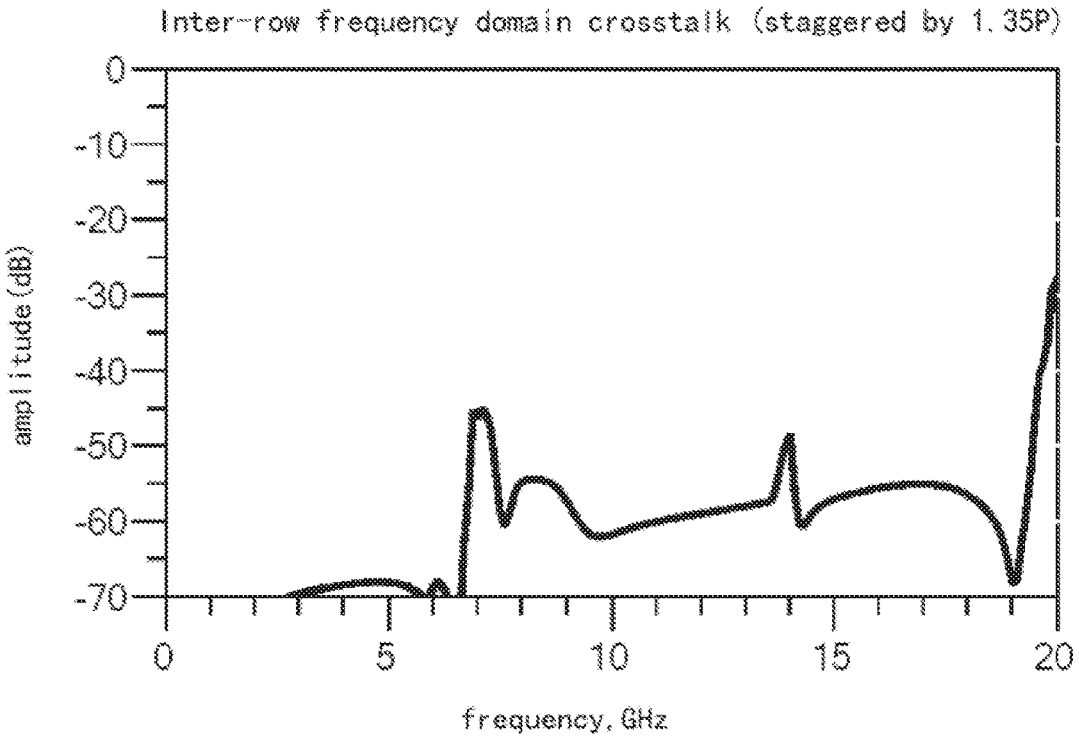
FIG. 10 is a graph of a frequency domain crosstalk between the two adjacent rows of contacts of the connector of FIG. 1 in the case where two corresponding contacts of the two adjacent rows of contacts are staggered by the second distance.
Figure 11:
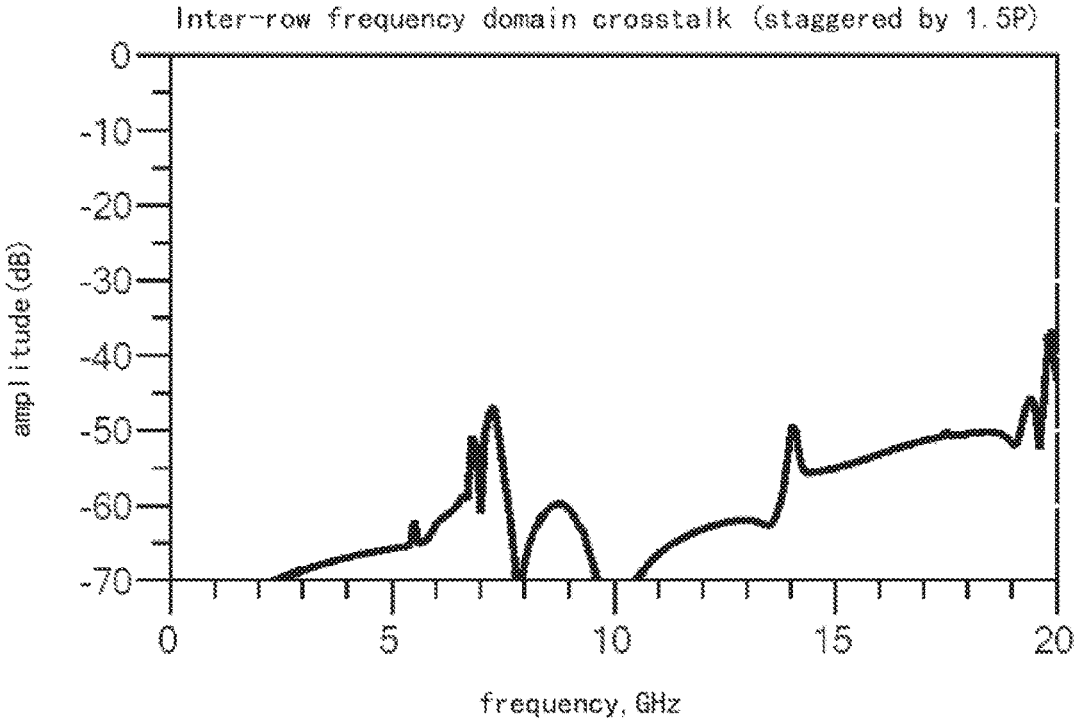
FIG. 11 is a graph of a frequency domain crosstalk between the two adjacent rows of contacts of the connector of FIG. 1 in the case where two corresponding contacts of the two adjacent rows of contacts are staggered by the third distance.
Figure 12:
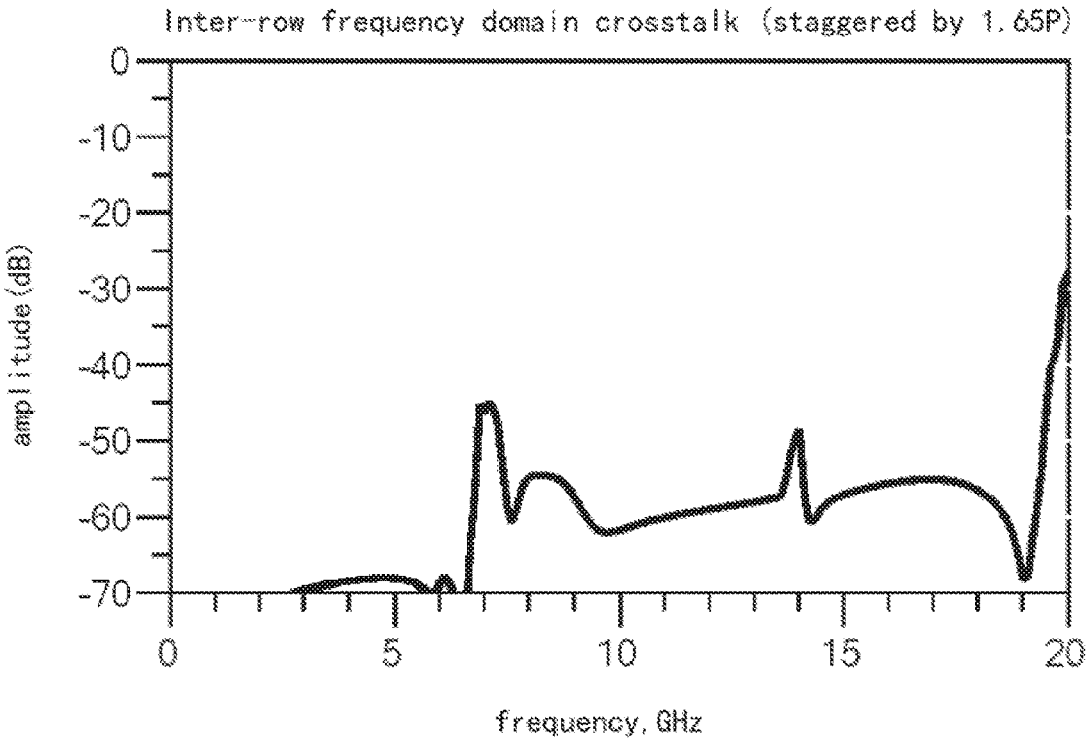
FIG. 12 is a graph of a frequency domain crosstalk between the two adjacent rows of contacts of the connector of FIG. 1 in the case where two corresponding contacts of the two adjacent rows of contacts are staggered by the fourth distance.
Figure 13:
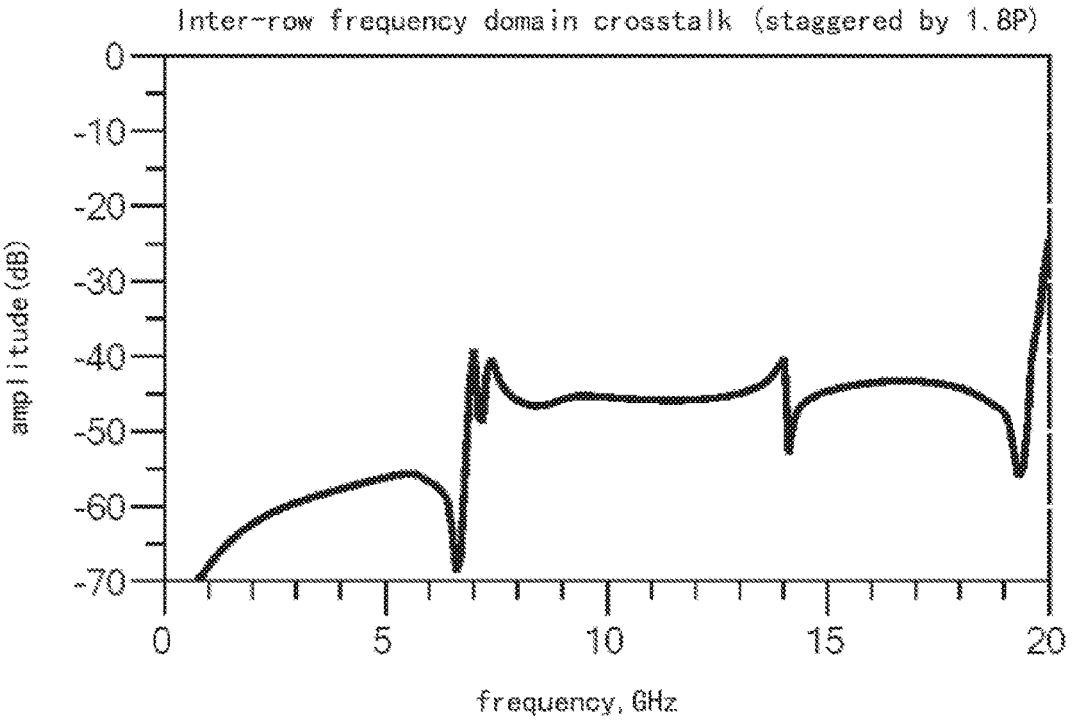
FIG. 13 is a graph of a frequency domain crosstalk between the two adjacent rows of contacts of the connector of FIG. 1 in the case where two corresponding contacts of the two adjacent rows of contacts are staggered by the fifth distance.

A spike in each of the graphs of an inter-row frequency domain crosstalk in FIGS. 8-13 corresponds to an inter-row resonance. When the two corresponding contacts of the two adjacent rows of contacts R1, R2 are staggered by a distance of 1.5 P, as shown in FIG. 11, amplitude of the spike in the graph of an inter-row frequency domain crosstalk is the smallest. When the two corresponding contacts of the two adjacent rows of contacts R1, R2 are not staggered, that is, the two corresponding contacts of the two adjacent rows of contacts R1, R2 are aligned with each other, as shown in FIG. 8, amplitude of the spike in the graph of an inter-row frequency domain crosstalk is the largest. As shown in FIGS. 9-11, when the staggered distance between the two corresponding contacts of the two adjacent rows of contacts R1, R2 of the connector 100 varies from 1.2 P to 1.5 P, the amplitudes of the spikes in the graphs of an inter-row frequency domain crosstalk decrease gradually. As shown in FIGS. 11-13, when the staggered distance between the two corresponding contacts of the two adjacent rows of contacts R1, R2 of the connector 100 varies from 1.8 P to 1.5 P, the amplitudes of the spikes in the graphs of an inter-row frequency domain crosstalk decrease gradually.

As shown in FIGS. 1 and 2, since a distance between the two adjacent rows of contacts R1, R2 in a second direction perpendicular to the first direction Y and parallel to the surface of the circuit board 10 is relatively small, electrical coupling between the adjacent two rows of contacts R1, R2 is relatively strong. In order to effectively suppress the resonance between the adjacent two rows of contacts R1 and R2, every part of any two corresponding contacts of the two adjacent rows of contacts R1, R2 are staggered in the first direction Y by the predetermined distance D, that is, the soldering portions W, the connecting portions C and the contact portions E of any two corresponding contacts of the two adjacent rows of contacts R1, R2 are also staggered in the first direction Y by the predetermined distance.

A connector 200 according to another embodiment of the invention will be described below with reference to FIGS. 14-18. The connector 200, as shown in FIGS. 14 and 15, has an insulation body 210 and at least two rows of contacts R1, R2 held in the insulation body 210.

Figure 14:
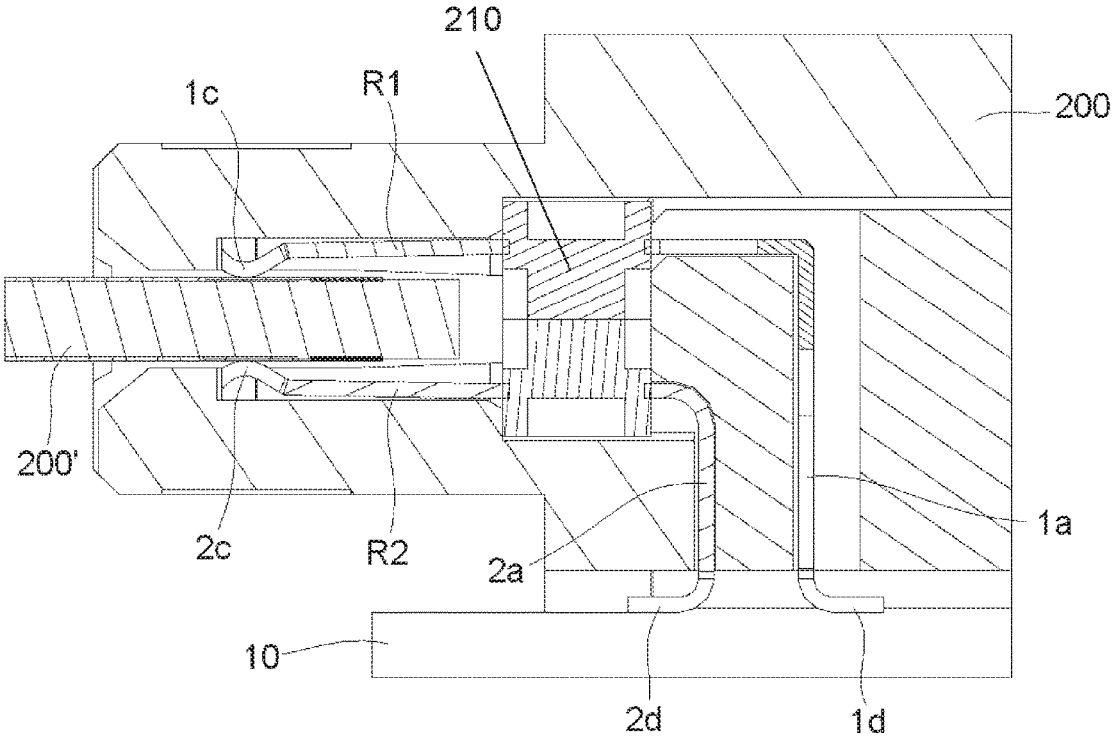
FIG. 14 is a sectional view of a connector according to another embodiment of the invention mated with a mating connector.
Figure 15:
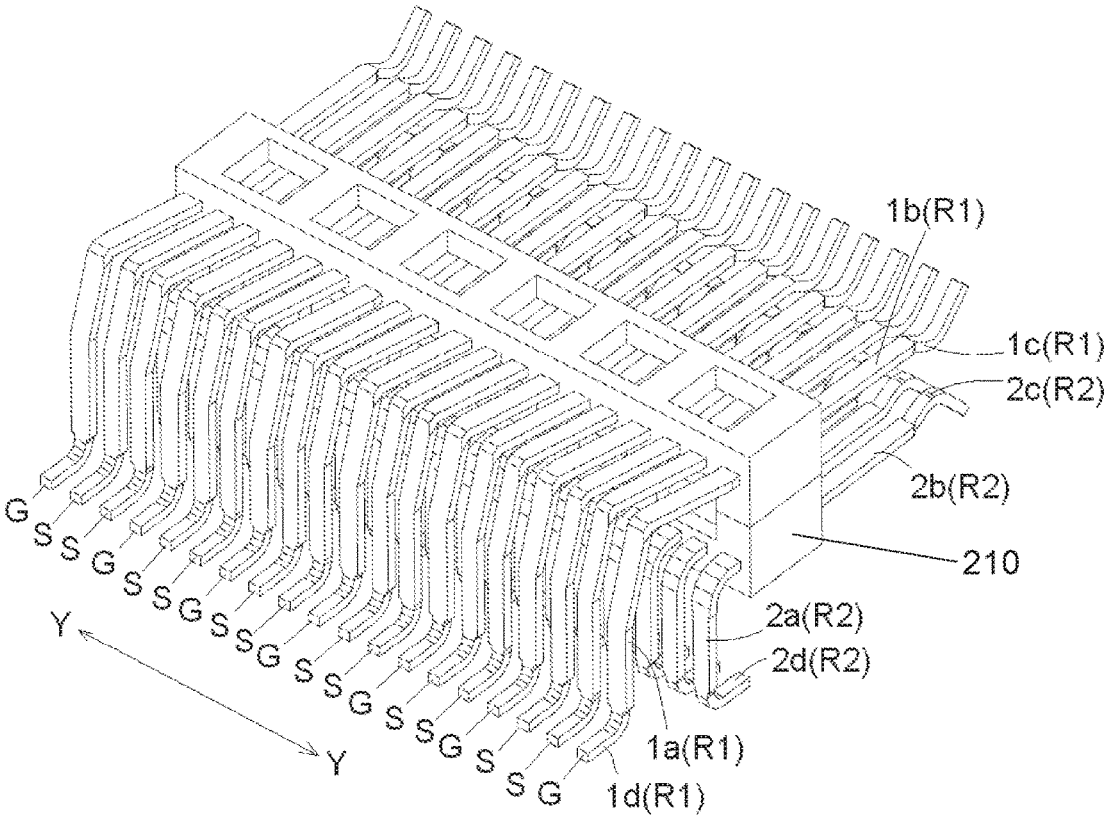
FIG. 15 is a perspective view of two adjacent rows of contacts of the connector of FIG. 14.

As shown in FIGS. 14 and 15, contacts of one of the two adjacent rows of contacts R1, R2 correspond to contacts of the other of the two adjacent rows of contacts R1, R2, respectively. Each row of contacts R1, R2 is arranged in a first direction Y and comprises at least one pair of high-speed differential signal contacts S, S; in the shown embodiment, each row of contacts R1, R2 has three or more pairs of high-speed differential signal contacts S, S. Each side of each pair of high-speed differential signal contacts S, S in each row of contacts R1, R2 is provided with a ground contact G. Thus, any two adjacent pairs of high-speed differential signal contacts S, S in each row of contacts R1, R2 are separated by a ground contact G.

Each contact of each row of contacts R1, R2, as shown in FIG. 14, comprises a soldering portion 1*d*, 2*d* adapted to be soldered to a circuit board 10, a contact portion 1*c*, 2*c* adapted to be in electrical contact with a mating connector 200', and a connecting portion for connecting the soldering portion and the contact portion. In the embodiment shown in FIGS. 14 and 15, the connecting portion comprises a first connecting portion 1*a*, 2*a* substantially perpendicular to a surface of the circuit board 10 and a second connecting portion 1*b*, 2*b* substantially parallel to the surface of the circuit board 10.

Figure 16:
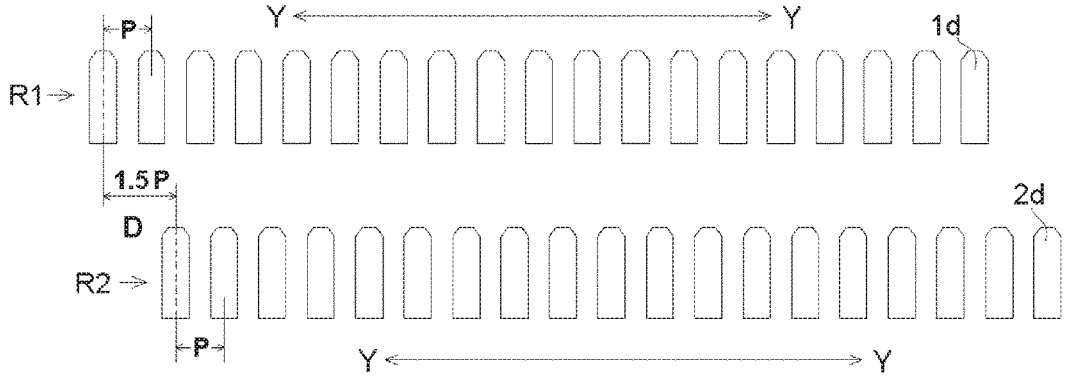
FIG. 16 is a plan view of soldering portions of the two adjacent rows of contacts of the connector of FIG. 14.

As shown in FIG. 16, at least parts of any two corresponding contacts of the two adjacent rows of contacts R1, R2 are staggered in the first direction Y by a predetermined distance D, so as to suppress a resonance between the two adjacent rows of contacts R1, R2. The predetermined distance D may be set to be 1.20-1.80 times of a contact pitch P between two adjacent contacts in each row of contacts R1, R2. In the embodiment shown in FIG. 16, at least parts of any two corresponding contacts from the two adjacent rows of contacts R1, R2 are staggered in the first direction Y by a predetermined distance D of 1.5 times the pitch P. In such an arrangement, the resonance between the two adjacent rows of contacts R1, R2 is theoretically zero. However, the predetermined distance D is not necessarily equal to 1.5 times the pitch P; when the predetermined distance D by which at least parts of any two corresponding contacts from the two adjacent rows of contacts R1, R2 are staggered in the first direction Y are set to be equal to 1.2 P, 1.35 P, 1.65 P or 1.8 P, the resonance between the two adjacent rows of contacts R1, R2 may also be suppressed.

Since a distance between the first connecting portions 1*a*, 2*a* of any two corresponding contacts of the two adjacent rows of contacts R1, R2 in a second direction perpendicular to the first direction Y and parallel to the surface of the circuit board 10 is relatively small, electrical coupling between adjacent two rows of contacts R1, R2 is relatively strong. However, in the embodiment shown in FIGS. 14 and 15, a distance between the second connecting portions 1*b*, 2*b* of any two corresponding contacts of the two adjacent rows of contacts R1, R2 in a third direction perpendicular to the surface of the circuit board 10 is relatively large, thus, the electrical coupling between the second connecting portions 1*b*, 2*b* of adjacent two rows of contacts R1, R2 is relatively weak. The second connecting portions 1*b*, 2*b* of any two corresponding contacts of the two adjacent rows of contacts R1, R2 are far apart, and the electrical coupling between the second connecting portions 1*b*, 2*b* is relatively weak. Just by staggering the first connecting portions 1*a*, 2*a* and the soldered portions 1*d*, 2*d* of any two corresponding contacts of the two adjacent rows of the contacts R1, R2 by the predetermined distance D in the first direction Y, the resonance between adjacent two rows of contacts R1 and R2 may be effectively reduced or eliminated, without requiring that every parts of any two corresponding contacts of the two adjacent rows of contacts R1 and R2 are staggered by the predetermined distance D. Only the first connecting portions 1*a*, 2*a* and the soldering portions 1*d*, 2*d* of any two corresponding contacts of the two adjacent rows of contacts R1, R2 are staggered in the first direction Y by the predetermined distance D, respectively, whereas the second connecting portions 1*b*, 2*b* and contact portions 1*c*, 2*c* of any two corresponding contacts of the two adjacent rows of contacts R1, R2 are not staggered (i.e. are aligned with each other), or staggered by a distance less than the predetermined distance D in the first direction Y.

Figure 17:
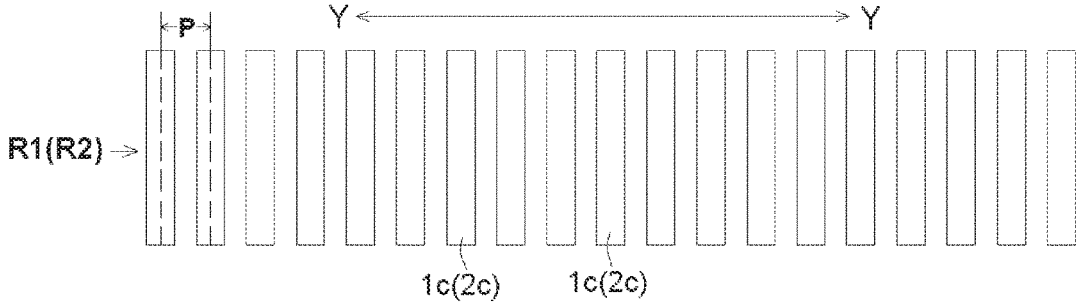
FIG. 17 is a plan view of contact portions of the two adjacent rows of contacts of the connector of FIG. 14.

As shown in FIGS. 16 and 17, the soldering portions 1*d*, 2*d* of any two corresponding contacts of the two adjacent rows of contacts R1, R2 are staggered in the first direction Y by a distance of 1.5 P, whereas the contact portions of 1*c*, 2*c* of any two corresponding contacts of the two adjacent rows of contacts R1, R2 are not staggered in the first direction Y, that is, the contact portions of 1*c*, 2*c* of any two corresponding contacts of the two adjacent rows of contacts R1, R2 are aligned with each other in the first direction Y. In other embodiments, the second connecting portions 1*b*, 2*b* and contact portions 1*c*, 2*c* of any two corresponding contacts of the two adjacent rows of contacts R1, R2 may also be staggered by a predetermined distance in the first direction, which may also reduce or eliminate resonance between two adjacent rows of contacts R1, R2.

Figure 18:
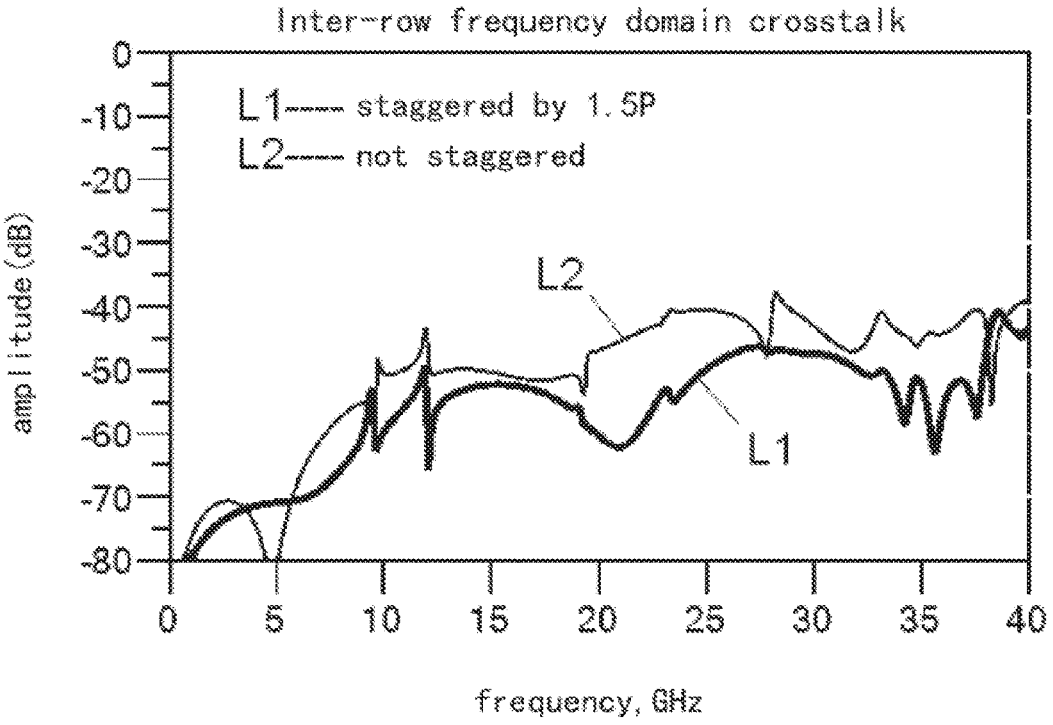
FIG. 18 is a graph of a frequency domain crosstalk between two corresponding contacts of the two adjacent rows of the connector shown in FIG. 14 in the case where the two corresponding contacts of the two adjacent rows of contacts are not staggered, and a graph of a frequency domain crosstalk between the two corresponding contacts of the two adjacent rows of the connector in the case where the two corresponding contacts of the soldering portions of the two adjacent rows of contacts are staggered.

As shown in FIG. 18, a graph L1 is a frequency domain crosstalk between two corresponding contacts of the two adjacent rows of contacts R1, R2 of the connector 200 shown in FIG. 15 in the case where the soldering portions 1*d*, 2*d* of any two corresponding contacts are staggered by a distance of 1.5 P, and a graph L2 shows a graph of a frequency domain crosstalk in the case where the soldering portions 1*d*, 2*d* of any two corresponding contacts are not staggered in the first direction Y. Comparing the graph L1 to the graph L2, it can be clearly seen that the amplitude of the spike in the graph of a frequency domain crosstalk between rows of contacts may be effectively reduced when the two corresponding contacts of the two adjacent rows of contacts R1 and R2 are staggered by a distance of 1.5 P, that is, resonance between two adjacent rows of contacts is effectively suppressed.

What is claimed is:

1. A connector, comprising:

an insulation body; and at least two rows of contacts disposed in the insulation body and extending in a first direction, a plurality of first contacts of a first row of the at least two rows of contacts corresponding to a plurality of second contacts of a second row of the at least two rows of contacts, a pair of corresponding contacts in the first row and second row are staggered in the first direction by a predetermined distance set to be 1.20-1.80 times a contact pitch between a pair of adjacent contacts in each of the first row and second row, and in each row of contacts any two adjacent pairs of the same type of contacts are separated from a pair of a second type of contacts by a ground in the same row as the pairs of adjacent contacts.

2. The connector of claim 1, wherein the predetermined distance is 1.35-1.65 times the contact pitch.

3. The connector of claim 1, wherein the predetermined distance is 1.5 times the contact pitch.

4. The connector of claim 1, wherein the predetermined distance is set such that a resonance between the first row and the second row is zero.

5. The connector of claim 1, wherein the first row and the second row each have at least one pair of high-speed differential signal contacts.

6. The connector of claim 5, wherein the first row and the second row each have a ground contact disposed on each side of each pair of high-speed differential signal contacts.

7. The connector of claim 6, wherein the first row and the second row each have at least one pair of low-speed differential signal contacts.

8. The connector of claim 7, wherein the first row and the second row each have a ground contact disposed on each side of each pair of low-speed differential signal contacts.

9. The connector of claim 1, wherein the first contacts and second contacts each have a soldering portion at a first end, a contact portion at an opposite second end, and a connecting portion connecting the soldering portion and the contact portion.

10. The connector of claim 9, wherein the soldering portions, the connecting portions, and the contact portions of any pair of corresponding contacts in the first row and second row are staggered in the first direction by the predetermined distance.

11. The connector of claim 9, wherein the soldering portions of any pair of corresponding contacts in the first row and second row are staggered in the first direction by the predetermined distance and the contact portions of any pair of corresponding contacts in the first row and second row are not staggered in the first direction.

12. The connector of claim 9, wherein the contact portions of any pair of corresponding contacts in the first row and second row are staggered in the first direction by the predetermined distance and the soldering portions of any pair of corresponding contacts in the first row and second row are not staggered in the first direction.

13. The connector of claim 1, wherein all portions of any pair of corresponding contacts in the first row and second row are staggered in the first direction by the predetermined distance.

14. The connector of claim 1, wherein a first portion of any pair of corresponding contacts in the first row and second row is staggered in the first direction by the predetermined distance and a second portion of the pair of corresponding contacts in the first row and second row is not staggered in the first direction by the predetermined distance or is staggered in the first direction by a distance less than the predetermined distance.

15. The connector of claim 14, wherein the first contacts and second contacts each have a soldering portion adapted to be soldered to a circuit board, a contact portion electrically contacting a mating connector, and a connecting portion connecting the soldering portion and the contact portion.

16. The connector of claim 15, wherein the connecting portion has a first connecting portion substantially perpendicular to a surface of the circuit board and a second connecting portion substantially parallel to the surface of the circuit board.

17. The connector of claim 16, wherein the first connecting portions and the soldering portions of any pair of corresponding contacts in the first row and second row are staggered in the first direction by the predetermined distance.

18. The connector of claim 17, wherein the second connecting portions and the contact portions of any pair of corresponding contacts in the first row and second row are not staggered or are staggered by a distance less than the predetermined distance in the first direction.

* * * * *